United States Patent [19]

Hubert

[11] 3,955,092

[45] May 4, 1976

[54] ARRANGEMENT FOR RESPECTIVELY WITHDRAWING A SINGLE FILM SHEET FROM A STACK OF DIRECTLY LOOSELY SUPERIMPOSED FILM SHEETS

[75] Inventor: Günter Hubert, Baiersdorf, Germany

[73] Assignee: Siemens Aktiengesellschaft, Erlangen, Germany

[22] Filed: Oct. 9, 1974

[21] Appl. No.: 513,494

[30] Foreign Application Priority Data

Oct. 13, 1973 Germany ..... 2351541

[52] U.S. Cl. ..... 250/468

[51] Int. Cl.[2] ..... G03B 41/16

[58] Field of Search ..... 250/468, 469, 470, 471

[56] References Cited

UNITED STATES PATENTS

| | | | |
|---|---|---|---|
| 3,584,867 | 6/1971 | Cargill | 271/121 |
| 3,820,136 | 6/1974 | Kennedy | 250/470 |

FOREIGN PATENTS OR APPLICATIONS

| | | | |
|---|---|---|---|
| 45,912 | 5/1966 | Japan | 250/468 |

*Primary Examiner*—Craig E. Church

*Attorney, Agent, or Firm*—Haseltine, Lake & Waters

[57] ABSTRACT

An arrangement for respectively withdrawing a single film sheet from a stack of directly loosely superimposed film sheets, particularly for use in X-ray filming apparatus, including a magazine for the film sheets, and transport means for the conveyance of the particular film sheet positioned on the floor of the magazine through a withdrawal slot of the magazine. In the floor there is formed, along a side wall of the magazine, the approximately 3 mm wide withdrawal slot which extends over the entire length of the side wall, and wherein the side wall is sloped in the elevation of the film sheet which is positioned on the floor at an angle of 10° to 25° relative to a perpendicular to the floor of the magazine away from the direction of the film stack. A roll may be employed in lieu of the edge of the withdrawal slot associated with the floor of the magazine, and in order to avoid any rubbing of the film surface against the edge which extends along the side wall, a further roll may be located in the withdrawal direction immediately proximate the withdrawal slot on the opposite side of the sloped side wall. A pusher element may be used which is slidable along the floor of the magazine towards and away from the withdrawal slot, and which has an approximately 0.8 film thickness projecting claw which engages the edge of the lowermost film sheet located directly on the floor of the magazine which is remote from the withdrawal slot.

5 Claims, 1 Drawing Figure

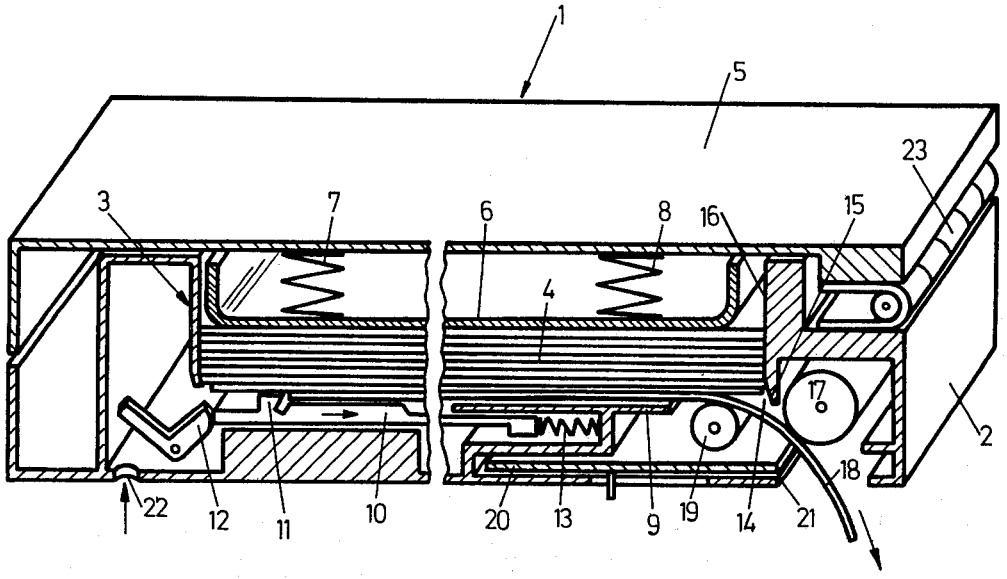
1
5
23
3
7
6
8
16
15
4
17
2
18
22
12
11
10
20
13
9
19
14
21

ARRANGEMENT FOR RESPECTIVELY WITHDRAWING A SINGLE FILM SHEET FROM A STACK OF DIRECTLY LOOSELY SUPERIMPOSED FILM SHEETS

FIELD OF THE INVENTION

The present invention relates to an arrangement for respectively withdrawing a single film sheet from a stack of directly loosely superimposed film sheets, particularly for use in X-ray filming apparatus, including a magazine for the film sheets, and transport means for the conveyance of the particular lowermost film sheet positioned on the floor of the magazine through a withdrawal slot of the magazine.

DISCUSSION OF THE PRIOR ART

An arrangement on a supply magazine for sheet film employed in X-ray filming installations is known, wherein individual film sheets are lifted from a stack of loosely superimposed film sheets in the supply magazine through the intermediary of a to-and-fro moved suction device, and then conveyed through a calibrated withdrawal slot. This prior art arrangement, which requires a separate vacuum generator, a device for the control of the vacuum in the suction device, and an installation for movement of the suction device, is relatively complex. Moreover, for satisfactory and trouble-free operation, the arrangement requires a not always present freedom from dust, since the retentive force of the suction device to a considerable extent depends upon complete positioning thereof on the film sheet, and may be appreciably influenced by the presence of a thin layer of dust. Finally, in this arrangement, there cannot be completely avoided the occasional scratching of the film surface at the calibrated withdrawal slot.

SUMMARY OF THE INVENTION

Accordingly, it is an object of the present invention to provide an arrangement for the withdrawal of, respectively, a single film sheet from a stack of directly superimposed film sheets, which allows for a high frequency of film sheet withdrawal, is as insensitive as possible against the entry of dust, and will not scratch the film sheets. In an arrangement of the abovementioned type there is thus provided in the floor, along a side wall of the magazine, an approximately 3 mm wide withdrawal slot which extends over the entire length of the side wall, and wherein the side wall is sloped with respect to the plane of the film sheet which is positioned on the floor at an angle of 10° to 25° relative to a perpendicular to the floor of the magazine away from the direction of the film stack. In this arrangement, the respective lowermost film sheet, upon pressing in the withdrawal direction against the front face side of the sloped portion of the side wall, slides along this side wall, is bent over in the direction towards the withdrawal and thereby separated from the successive film sheet.

The sliding friction of the respective lowermost film sheet on the floor of the magazine which is to be withdrawn is avoided when, in an advantageous modification of the invention, a roll is employed in lieu of the edge of the withdrawal slot associated with the floor of the magazine.

In order to avoid any rubbing of the film surface against the edge which extends along the side wall, in an advantageous further modification of the invention, a roll may be located in the withdrawal direction immediately behind the withdrawal slot on the side of the sloped side wall. Thus, the particular film sheet which is to be withdrawn slides thus with the leading edge thereof along the sloped portion of the side wall, upon passing by the withdrawal slot roller along the roll, and supported by the inherent elasticity of film sheets, is raised away from the edge of the side wall.

In an advantageous embodiment of the invention, there may be employed a pusher element which is slidable along the floor of the magazine towards and away from the withdrawal slot, and which has an approximately 0.8 film thickness projecting claw which engages the edge of the outermost film sheet located directly on the floor of the magazine which is remote from the withdrawal slot. Such a pusher element may be simply constructed and dependable in operation.

Particularly high film sheet withdrawal frequencies may be achieved when, in an advantageous further embodiment of the invention, the roll which is associated with the floor of the magazine for conveyance of the particular outermost film sheet on the floor is driven in the withdrawal direction. This construction avoids to-and-fro moving weights and affords even at high frequencies of film withdrawal a quiet vibration-free operation. This advantage is of not to be undervalued significance, particularly with regard to the constantly increasing requirements for image sharpness.

BRIEF DESCRIPTION OF THE DRAWING

Further details of the invention may now be ascertained from the following detailed description thereof, taken in conjunction with the single FIGURE of the accompanying drawing; in which:

The FIGURE of the drawing shows a sectional perspective view of an arrangement for the withdrawal of respectively a single film sheet from a stack of directly superimposed film sheets, which is built into a magazine cassette.

DETAILED DESCRIPTION

Referring now in detail to the drawing, from the single FIGURE there may be ascertained, in sectional representation, a magazine cassette 1 in whose housing sub-section 2 there is inserted a magazine 3 adapted to receive a stack 4 of film sheets. The magazine cassette 1 is closed in a light-sealed manner by means of a cover 5. In the cover there is suspended a pressure plate 6 through the use of two springs 7, 8 which press against the stack 4 of the film sheets upon closure of the cover. In the floor 9 of the magazine 3 there is located a pusher element 10 having an inclined claw 11, which may be displaced through the action of a tilting lever 12 against the force of a spring 13 into the direction of a withdrawal slot 14 which is located on the opposite side in the floor of the magazine. The withdrawal slot 14 extends across the entire width of the magazine 3. The portion 15 of the side wall of the magazine which borders directly on the withdrawal slot 14 is sloped away from the film stack at an angle in the extent of 10° to 25° with respect to a perpendicular to the floor 9 of the magazine. Immediately behind this sloped portion 15 of the side wall 16 of the magazine there is located an idle running roll 17 in the direction of withdrawal of the film sheets, which minutely projects with respect to the sloped portions 15 of the side wall and against which lie the film sheets 18 emanating from the withdrawal slot. At the edge of the withdrawal slot 14 which is formed by the floor 9 of the magazine, there is located a further roll 19. In the apparatus sub-portion 2 of the magazine cassette 1 there is also located opposite to the withdrawal slot 14 a cutout 21, which may be closed off in a light-sealing manner by a slide 20, and through which there may exit the film sheets which are withdrawn from the stack. Additionally, located in the housing sub-portion of the magazine cassette opposite to the tilting lever 12, there is provided an aperture 22 through which the tilting lever may be actuated from exteriorly thereof.

Upon the insertion of the magazine cassette in an apparatus to which the film sheets are to be individually conveyed, such as, for example, an X-ray examining apparatus, the slide 20 of the magazine cassette 1 may be automatically opened through the intermediary of a projecting contact as soon as the magazine cassette is locked into the X-ray examining apparatus. In this locked-in position, the aperture 22 of the magazine casette is concurrently positioned above a contact pin (not shown) of the apparatus. For removing of a film sheet it is sufficient that the tilting lever 12 which is located above the aperture 22 may be pressed upwardly by the contact pin of the apparatus. Consequently, the pusher element 10 is displaced against the force of spring 13 in a direction towards the withdrawal slot 14 of magazine 3. The claw 11 of the pusher element 10, which projects by 0.8 film thicknesses, hooks into the rear edge of the film sheet positioned directly on the floor of the magazine, as viewed in a conveying direction, and slides the film sheet against the sloped portion 15 of the side wall 16 of the magazine. The force which is transmitted to the film sheet from the claw is sufficient to permit the leading edge of the film sheet, as viewed in the direction of conveyance, to slide from the sloped portion 15 of the side wall. The leading edge of the film sheet slides onto the roll 18 associated with the side wall. The film sheet is then rollingly pushed between the two mutually oppositely positioned rolls 17, 19 through the withdrawal slot 14 until it is engaged by the conveyor means of the attached apparatus and transported further. The force which is transmitted by the lowermost film sheet to the successive film sheet, based on experience, is too small to allow the second film sheet to slide along therewith. Through the bending over of the lowermost film sheet during sliding along the sloped portion of the side wall, there is concurrently carried out a separation of mutually adhering film sheets. After the film sheets located in the magazine cassette 1 have been used up, the magazine cassette may be removed from the X-ray examining apparatus and opened in a darkroom. By means of the cover 5 which is linked to a hinge 23, and the pressure plate 6 which is fastened to the cover, the refilling of the magazine cassette with a new stack of film sheets is facilitated in darkness.

It is also possible to provide a cutout in the side wall of the magazine cassette 1 as an extension of the axis of the roll 19 which is associated with the floor of the magazine, through which this roll 19 may be driven. Upon driving of the roll 19 associated with the floor 9 of the magazine, the film sheets may be pushed further through the withdrawal slot 14, as would be possible with use of only the pusher element 10. In driving the roll 19 associated with the floor of the magazine, the to-and-fro moving pusher element 10 with its claw 11 may also be completely omitted. Due to the low forces which are then transmitted by the film sheet which is located on the floor 9 of the magazine the angle of inclination of the sloped portion 15 of the side edge 16 of the magazine with respect to a perpendicular to the floor 9 of the magazine may be increased in the region of the above-mentioned tolerance range. Basically, it is also possible that, in lieu of a pusher which is provided with a claw, there may be employed a pusher which is provided with a suction cup.

While there has been shown what is considered to be the preferred embodiment of the invention, it will be obvious that modifications may be made which come within the scope of the disclosure of the specification.

What is claimed is:

1. In an arrangement for respectively withdrawing a single film sheet from a stack of directly loosely superimposed film sheets, particularly for use in X-ray filming apparatus, including a magazine having said stack of film disposed therein; and transport means for conveying the lowermost film sheet of said stack positioned on the floor of said magazine through a withdrawal slot in said magazine, the improvement comprising: said withdrawal slot being formed in the floor of said magazine extending along a side wall of the latter and having a width of approximately 3 mm; means for separating the lowermost film sheet from the superposed film sheet including a portion of said side wall of said magazine in the vertical elevation of the film sheet positioned on the floor of said magazine being sloped at an angle in the range of 10° to 25° with respect to a perpendicular to the floor of said magazine away from the direction of said film stack; a first rotatable roll extending along the edge of the withdrawal slot associated with the floor of said magazine; and means for preventing rubbing of a film sheet along the edge of the withdrawal slot during withdrawal including a second rotatable roll located in the sheet withdrawing direction in close proximity to said withdrawal slot in parallel spaced relationship with said first rotatable roll at the other side of said sloped side wall, said film sheet adapted to be conveyed between said rotatable rolls.

2. An arrangement as claimed in claim 1, said first rotatable roll associated with the floor of said magazine being driven in the withdrawal direction for conveyance of said film sheet positioned on the floor of said magazine.

3. An arrangement as claimed in claim 1, comprising a cassette-like housing for receiving said arrangement, said housing having a cutout portion associated with said withdrawal slot, and an aperture for effecting actuation of said film sheet transport means.

4. An arrangement as claimed in claim 1, comprising a pusher element adapted to be moved along the floor of said magazine towards and away from said withdrawal slot; and a claw on said pusher element having a height of about 0.8 film thicknesses for engaging the respective lowermost film sheet positioned on the floor of the magazine at the edge thereof remote from said withdrawal slot.

5. An arrangement as claimed in claim 4, said claw being an inclined projection on said pusher element.

* * * * *